United States Patent [19]

Fujita

[11] Patent Number: 5,030,149

[45] Date of Patent: Jul. 9, 1991

[54] POWER TRANSMISSION ARRANGEMENT FOR CONTRA-ROTATING PROPELLER SHAFTS

[75] Inventor: Tatuo Fujita, Yokohama, Japan

[73] Assignee: Ishikawajima-Harima Heavy Industries Co., Ltd., Tokyo, Japan

[21] Appl. No.: 568,939

[22] Filed: Aug. 17, 1990

[30] Foreign Application Priority Data

Aug. 28, 1989 [JP] Japan ..... 1-99044[U]

[51] Int. Cl.[5] ..... B63H 23/00

[52] U.S. Cl. ..... 440/75; 440/81; 416/129

[58] Field of Search ..... 440/75, 80, 81; 416/128, 129, 124, 127, 170 R; 192/55, 3.51; 74/664, 665 A, 665 D

[56] References Cited

U.S. PATENT DOCUMENTS 3,688,732 9/1972 Singelmann et al. ..... 440/80
4,642,059 2/1987 Nohara ..... 440/81
4,963,108 10/1990 Koda et al. ..... 440/81

FOREIGN PATENT DOCUMENTS 244791 10/1987 Japan ..... 440/81
93698 4/1988 Japan ..... 440/80

*Primary Examiner*—Sherman Basinger
*Assistant Examiner*—Stephen P. Avila
*Attorney, Agent, or Firm*—Dykema Gossett

[57] ABSTRACT

An arrangement for transferring power of an engine to front and rear propellers of a ship comprises an inner propeller shaft directly coupled to the engine, an outer propeller shaft coupled to the engine via the planetary gear set in a manner such that the front propeller rotates in a direction opposite to the direction the rear propeller rotates. The planetary gear set includes first planetary gears coupled to the inner propeller shaft and secondary planetary gears coupled to the outer propeller shaaft and one clutch is provided between each pair of first and second planetary gears. Since there are provided a plurality of clutches, the torque imposed on each clutch is relatively small. Also, the torque on the clutch is reduced by the planetary gear set. Therefore, a clutch of small capacity can be employed. This makes the arrangement compact and the maintenance of the clutch easy.

18 Claims, 6 Drawing Sheets

CLUTCH ENGAGED

CLUTCH DISENGAGED

POWER TRANSMISSION ARRANGEMENT FOR CONTRA-ROTATING PROPELLER SHAFTS

BACKGROUND OF THE INVENTION

1. Technical Field

The present invention relates to an arrangement for transmitting torque of a main unit of a ship to oppositely rotating, double propeller shafts (generally called "contra-rotating propeller shafts) through a planetary gear train.

2. Background Art

As shown in FIG. 6 of the accompanying drawings, a propulsion system having contra-rotating propeller shafts for a ship includes two propeller shafts, namely an inner propeller shaft 105 and an outer propeller shaft 107, and two propellers 104 and 106 respectively mounted on the propeller shafts 105 and 107. The front propeller 106 is larger than the rear propeller 104 and they are spaced in the direction of the propeller shaft 105 by a predetermined distance. The inner propeller shaft 105 is coupled to an output shaft 102 of a main propulsion system 101 of a ship. The inner propeller shaft 105 is partially surrounded by a hollow shaft 109 of a sun gear 108 and the sun gear 108 is connected to the inner propeller shaft 105 via a clutch 110. The sun gear 108 meshes with a first planetary gear 111. The first planetary gear 111 is intergral with a second planetary gear 112 which is larger than the first planetary gear 111 in diameter. The second planetary gear 112 meshes with an internal gear 114. The internal gear 114 meshes with a gear 113 which is integral with the outer propeller shaft 107. In this manner, the inner propeller shaft 105 is drivingly connected to the outer propeller shaft 107 and the propeller shafts are roated in opposite directions.

When the ship is operated by two propeller shafts, chattering of the planetary gear set and stress of the inner propeller shaft must be taken into account. Combustion takes place in the main unit 1 (engine) and vibrations (generally tortional vibraions) due to the combustion are transmitted to the propellers 4 and 6. The vibration torque has its peak (a resonance point) at a natural frequecy of a power transmission line (the engine 1, the propellers 4 and 6 and other members) of the ship. FIG. 3 shows a case where a ship is propelled by two propellers and the power transmission line of the ship has a resonance frequency of 81.9 r/m (revolutions per minute). The dashed line A indicates a vibration torque, exerted on the gears and peripheral elements thereof the two-dot line B indicates an average torque exerted on the gears and peripheral elements thereof and the solid line C indicates a stress of the inner propeller shaft. When the vibration torque A is below the curve of average torque B, i. e., when the ship is operated at a speed beyond 93 r/m, the chattering does not occur. However, if the vibration torque A becomes greater than the average torque curve B (range D), the gears of the planetary gear set start chattering. The gears may be broken due to the chattering and therefore the gears cannot be used continuously. The stress C of the inner propeller shaft also has its peak at the natural frequency (81.9 r/m) of the power transmission line. In addition, the operation at a speed near 81.9 r/m (natural frequency) causes vibrations of the ship body and the engine. Therefore, it is not preferable to operate the ship at a speed near the natural frequency of 81. 9 r/m. In summary, with the chattering and the stress of the inner propeller shaft being considered, the ship have to be operated at a speed beyond 93 r/m as far as the two propeller are driven.

When the ship is approaching a harbor, for example, the speed of the ship is lowered. However, the ship should not be operated at a speed lower than 93 r/m as far as the two propellers 104 and 106 are driven. In this case, the outer propeller shaft 107 or the front propeller 106 is disconnected from the engine and the ship is driven by only the rear propeller 104. Upon the disconnection of the outer propeller shaft 107, the gears of the planetary gear set which would cause the chattering bear no load. Thus, the chattering does not occur at any speed. With respect to the stress of the inner propeller shaft 105, the natural frequency of the power transmission line is shifted to a higher value (from 81.9 to 98), as indicated by the line E in FIG. 4, since the inertia of the power transmission line is decreased. Then, no problem would occur even if the ship is operated at a speed below 93 r/m. Referring back to FIG. 6, the inertia of the power transmission line is changed by the disengagement of the clutch 110, i. e., the clutch 10 disconnects the shaft 9 of the sun gear 8 from the propeller shaft 5, whereby the inertia is lowered. MCR in FIGS. 3 and 4 stands for Maximum Continuous Revolution.

Meantime, in the arrangement of FIG. 6, the clutch 110 is provided on the inner propeller shaft whose diameter is large. A large torque is produced on the inner propeller shaft 102 as the propeller shaft 102 is rotated by the engine 101. Thus, a large torque is applied to the clutch 110 upon engagement of the clutch 110 as well as during propulsion torque transmission from the engine 101 to the outer propeller shaft 107. As a result, the conventional arrangement has to be very rigid and requires a clutch having a large capacity in terms of transmission torque.

In addition, time-consuming, troublesome work is necessary in the routine maintenance of the clutch 110. This is because it is necessary to remove a housing of the planetary gear set 103 and the planetary gears and then to move the propeller 104 and the inner propeller shaft 105 toward the end of the ship before the maintenance. Furthermore, since the conventionally employed clutch 110 is very large, as mentioned earlier, the maintenance is itself not easy.

SUMMARY OF THE INVENTION

An object of the present invention is to provide a power transmission arrangement for a ship having contra-rotating propellers which enables an easy maintenance of a clutch.

Another object of the present invention is to provide a power transmission arrangement for a ship having contra-rotating propellers which permits use of a compact, easy to maintain clutch.

In order to achieve the objects of the present invention, a clutch is provided between a group of first planetary gears and a group of second planetary gears of a planetary gear set connecting an inner propeller shaft with an outer propeller shaft. According to one aspect of the present invention, there is provided an arrangement characterized in that the inner propeller shaft coupled to a rear propeller is connected to an engine, the outer propeller shaft coupled to a front propeller is connected to the engine via the planetary gear set in a manner such that the the front propeller rotates in a direction opposite to the direction the rear propeller rotates, a sun gear of the planetary gear set is fixed to the inner propeller shaft, the first planetary gears mesh with the sun gear, the first planetary gears are connected to one end of the clutch, the second planetary gears are connected to the other clutch such that the second planetary gears are connected to the first planetary gears when the clutch is in an engaged condition and disconnected from the first planetary gears when the clutch is in the disengaged condition, and the second planetary gears are connected to the outer propeller shaft via an internal gear and an external gear of the planetary gear set. The outer propeller shaft may be a hollow shaft and the inner propeller shaft rotatably extends through the outer propeller shaft. Each first planetary gear may have a shaft extending toward the engine, each second planetary gear may also have a shaft extending toward the engine and each clutch is provided to connect and disconnect the free ends of the shafts of the first and second planetary gears. Each clutch can be small since the clutch is provided between the first and second planetary gears and there are provided a plurality of clutches and the torque transferred to the clutch is reduced as the propulsion torque is transmitted to the clutch from the engine through the sun gear and the first planetary gear. The reduction of the torque is proportional to a gear ratio between the first planetary gear, the second planetary gear and the sun gear. The maintenance of the clutch is easy since a technician or an engineer can access the clutch by only removing a casing of the clutch.

DESCRIPTION OF THE PREFERRED EMBODIMENTS

An embodiment of the present invention will be described with reference to the accompanying drawings.

Figure 1:
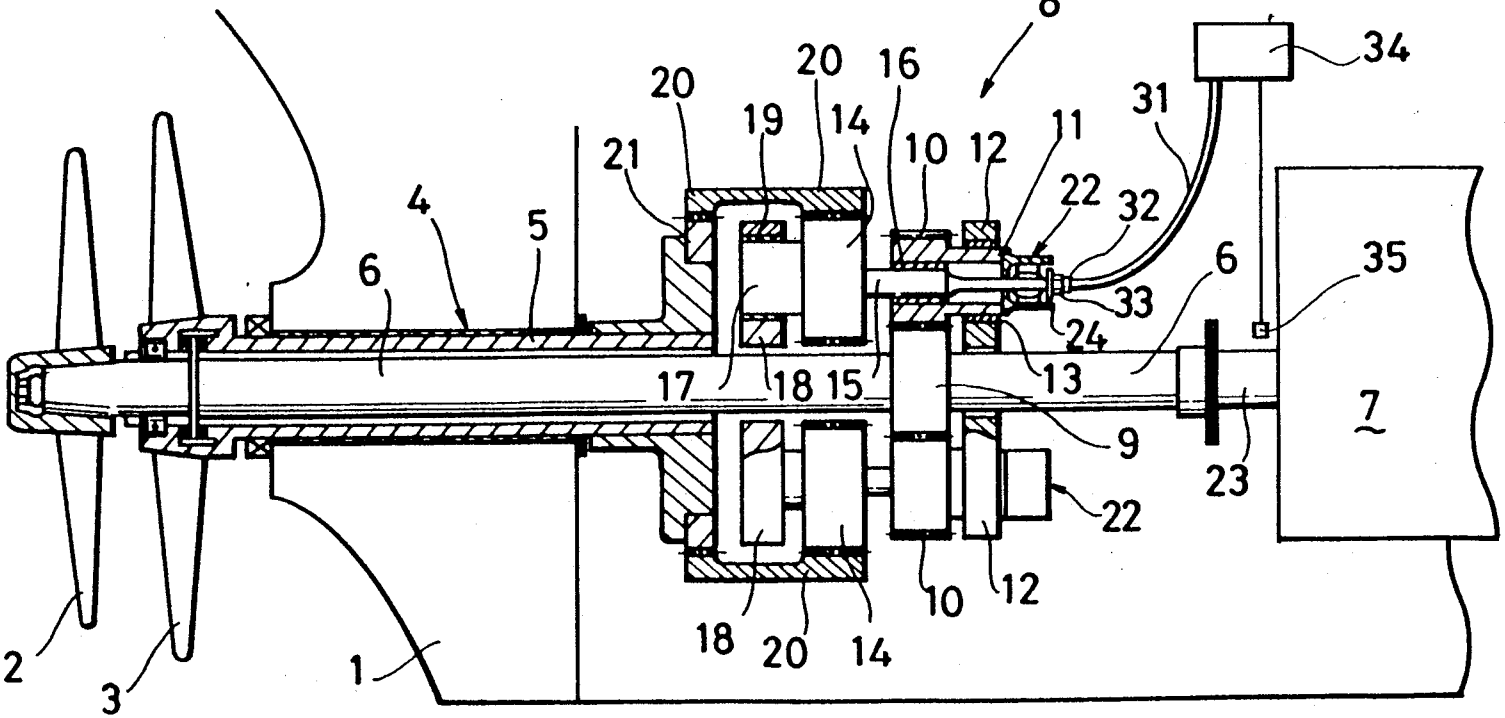
FIG. 1 is a schematic lateral view of a propulsion power transmission arrangement according to an embodiment of the present invention.

Referring to FIG. 1, a ship has two propellers 2 and 3 at its stern 1. The rear propeller 2 is coaxial with the front propeller 3. The rear and front propellers 2 and 3 are connected to an engine 7 via a contra-rotating shaft assembly 4. The shaft assembly 4 includes an outer propeller shaft 5 coupled to the front propeller 3 and an inner propeller shaft 6 coupled to the rear propeller 2. The outer propeller shaft 5 is a hollow shaft and the inner propeller shaft 6 rotatably extends through the outer propeller shaft 5.

The inner propeller shaft 6 rotates in a direction opposite to the direction the outer propeller shaft 5 rotates due to a planetary gear set 8. The planetary gear set 8 is provided between the engine 7 and the outer propeller shaft 5. The planetary gear set 8 includes a sun gear 9, a plurality of (between six and eight) first planetary gears 10 and second planetary gears 14. The sun gear 9 is integral with the inner propeller shaft 6. Each first planetary gear 10 has a hollow shaft 11 extending toward the engine 7. The shaft 11 is rotatably supported by a bearing 13 fitted in a frame 12. The frame 12 is loosely mounted on the inner propeller shaft 6. Each second planetary gear 14 has a shaft 15. The second planetary gear shaft 15 extends through the first planetary gear shaft 11 toward the engine 7. The second planetary gear shaft 15 is rotatably supported by a bearing 16 fitted in the first planetary gear 10. The second planetary gear has another shaft 17 extending in the opposite direction as the shaft 15 extends. The shaft 17 is supported by a bearing 19 provided in a frame 18. The frame 18 is coupled with the frame 12. The second planetary gear 14 has teeth more than the first planetary gear 10 so that the rotational speed of the inner gear 20 is raised. The second planetary gears 14 mesh with an internal gear 20 and the internal gear 20 meshes with an external gear 21 mounted on the outer propeller shaft 5.

A plurality of clutches 22 are provided between the first planetary gears 10 and the second planetary gears 14. Specifically, one clutch 22 is provided between a pair of first and second planetary gears 10 and 14. The clutches 22 connect the front propeller 3 with the engine 7 and allow the front propeller 3 to rotate in a direction opposite to the direction the rear propeller 2 rotates when the clutches 22 are in an engaged condition. When the clutches 22 are brought into the engaged condition, the power of the engine 7 is transferred from the output shaft 23 of the engine 7 to the front propeller 3 via the planetary gear set 8 as well as to the rear propeller 2 directly. In this case, the first and second planetary gears 10 and 14 rotate about their own shafts 11 and 15 in the opposite direction as the sun gear 9 rotates and do not rotate around the sun gear 9. Thus, the front propeller 3 rotates in the opposite direction as the rear propeller 2 rotates.

When the clutches 22 are brought into the disengaged condition, the clutches 22 disconnect the outer propeller 3 from the engine 7 and do not allow the front propeller 3 to rotate. Thus, only the rear propeller 2 rotates.

Figure 2:
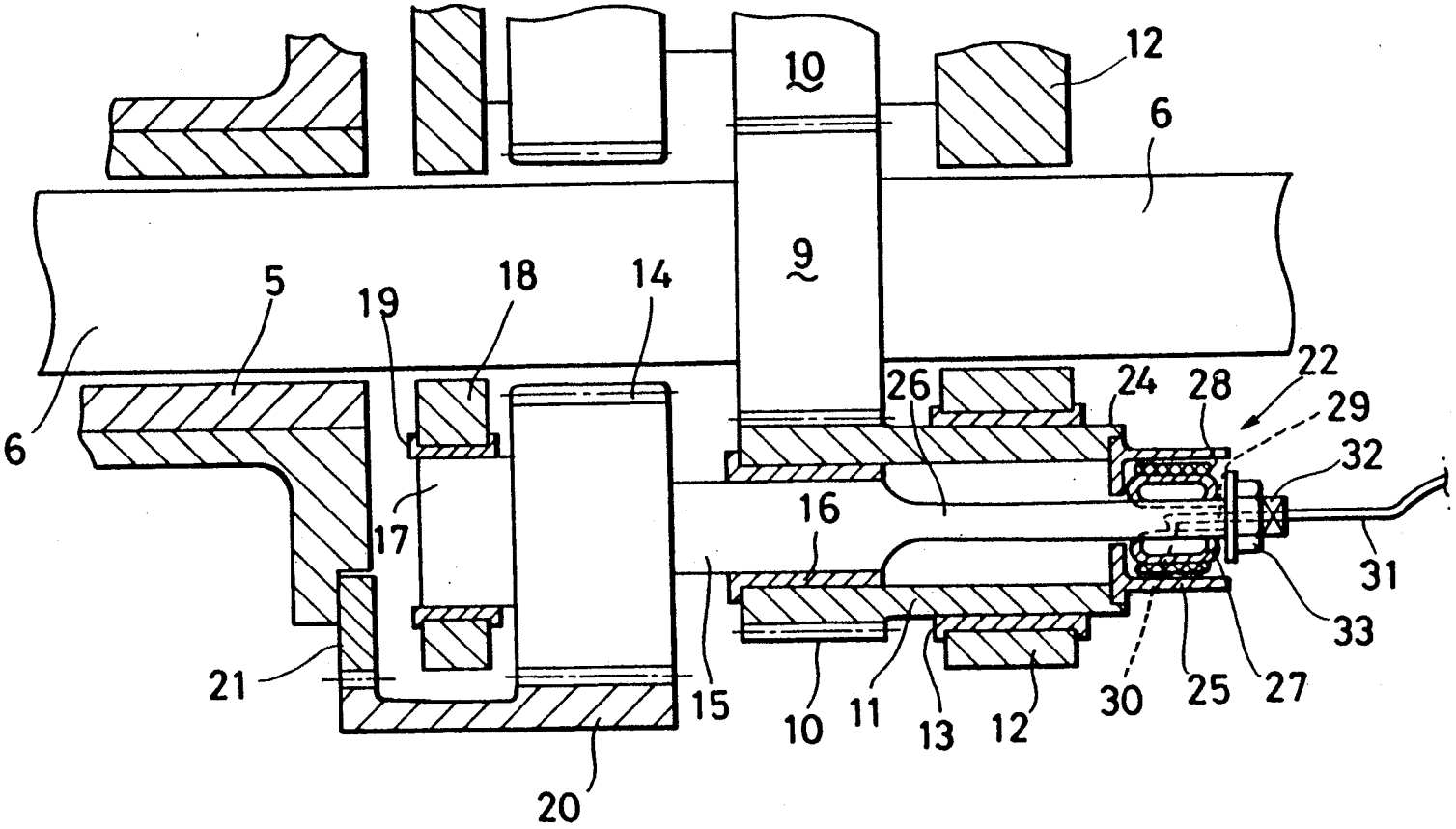
FIG. 2 is an enlarged view of a major part of FIG. 1.

FIG. 2 shows a detail of the clutch 22. The clutch 22 includes a cylindrical drum 25, a rod 26 extending through the drum 25 and an elastic tube 27 for connecting and disconnecting the drum 25 (first planetary gear 10) and the rod 26 (second planetary gear 14). The drum 25 is mounted on a free end 24 of the first planetary gear shaft 11. The rod 26 is integral with the second planetary gear shaft 15. The elastic tube 27 expands as working fluid such as pressurized air or oil is supplied into the elastic tube 27 and shrinks as the working fluid is discharged therefrom. The first planetary gear 10 is connected with the second planetary gear 14 when the elastic tube 27 expands and disconnected from the second planetary gear 14 when the elastic tube 27 shrinks. The clutch 22 extends toward the engine 7. The elastic tube 27 partially encloses the rod 26 of the second planetary gear shaft 15. A lining 28 is attached on the outer surface of the elastic tube 27 to ensure a decent connection between the first and second planetary gears 10 and 14 and to prevent a wear of the elastic tube 27. A passage 29 is formed in the rod 26 to allow the working fluid to be introduced into and discharged from the elastic tube 27. One end 30 of the passage 29 faces the interior of the elastic tube 27. The other end of the elastic tube 27 is connected to a working fluid supply line 31. A swivel joint 32 is provided between the passage 29 and the working fluid supply line 31 with a nut 33 so that the supply line 31 can be stationary while the rod 26 rotates.

Referring back to FIG. 1, the working fluid line 31 is connected to a clutch controller 34. The controller 34 controls the engagement and the disengagement of the clutches 22 in accordance with the rotational speed of the output shaft 23 of the engine 7. The rotational speed of the shaft 23 is detected by a speed sensor 35 located in the vicinity of the shaft 23.

Figure 3:
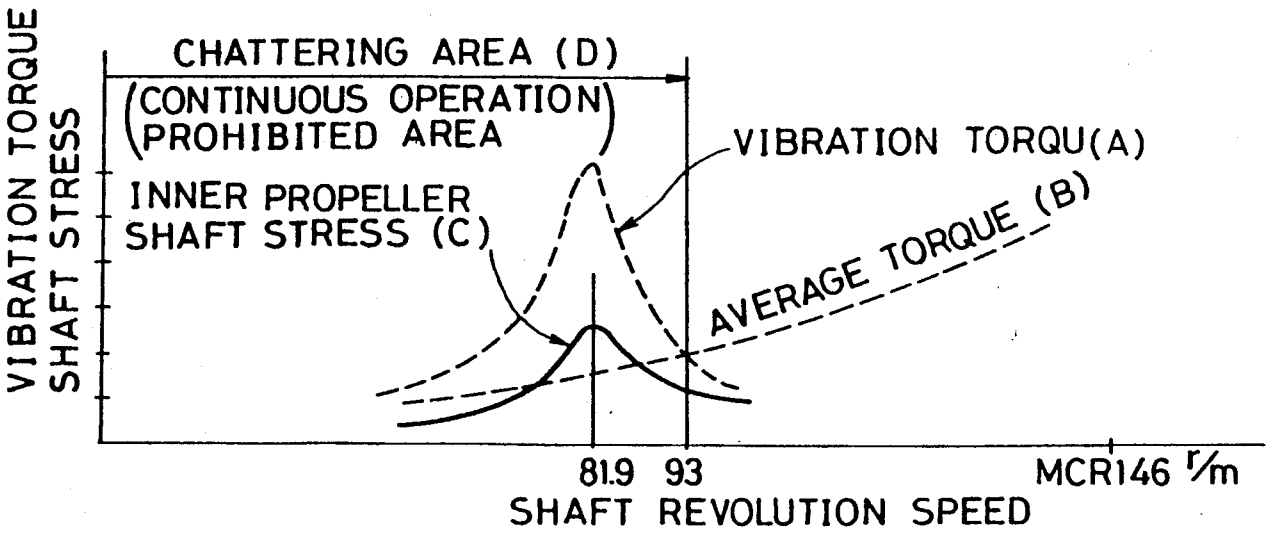
FIG. 3 shows a relation between revolution speed, stress and vibration torque when a clutch is in an engaged condition.
Figure 4:
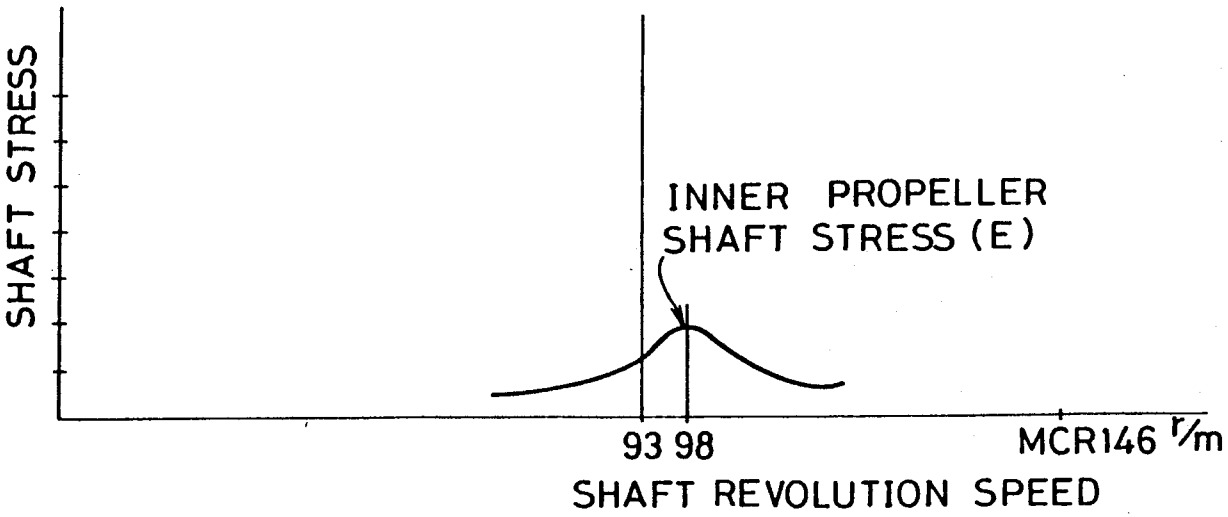
FIG. 4 shows a relation between revolution speed and stress when the clutch is in a disengaged condition.

When the clutches 22 are brought into an engaged condition, the power transmission line of the ship has a relatively large inertia. Therefore, the natural frequency of the power transmission line is a relatively low value, for example 81.9 r/m, as shown in FIG. 3. As expalined in the "Background Art" of this specification, the ship is free from chattering and the stress on the inner propeller shaft 6 raises no problem when the ship moves at a speed beyond 93 r/m. Thus, the controller 34 maintains the clutches 22 in an engaged conditions. When the ship lowers the speed, the speed sensor 35 detects the drop of the speed and the controller 34 brings the clutches 22 into the disengaged condition. Thereupon, the natural frequency of the power transmission line is shifted to 98 r/m from 81.9 r/m. In this case, the chattering does not have to be considered since the items which would cause the chattering are disconnected from the engine 7. With respect to the stress on the inner propeller shaft 6, the peak of the stress is also shifted to the high revolution area (FIG. 4) as the natural frequency is shifted to the higher value. Therefore, no problem occurs with the ship moving at a low speed.

Figure 6:
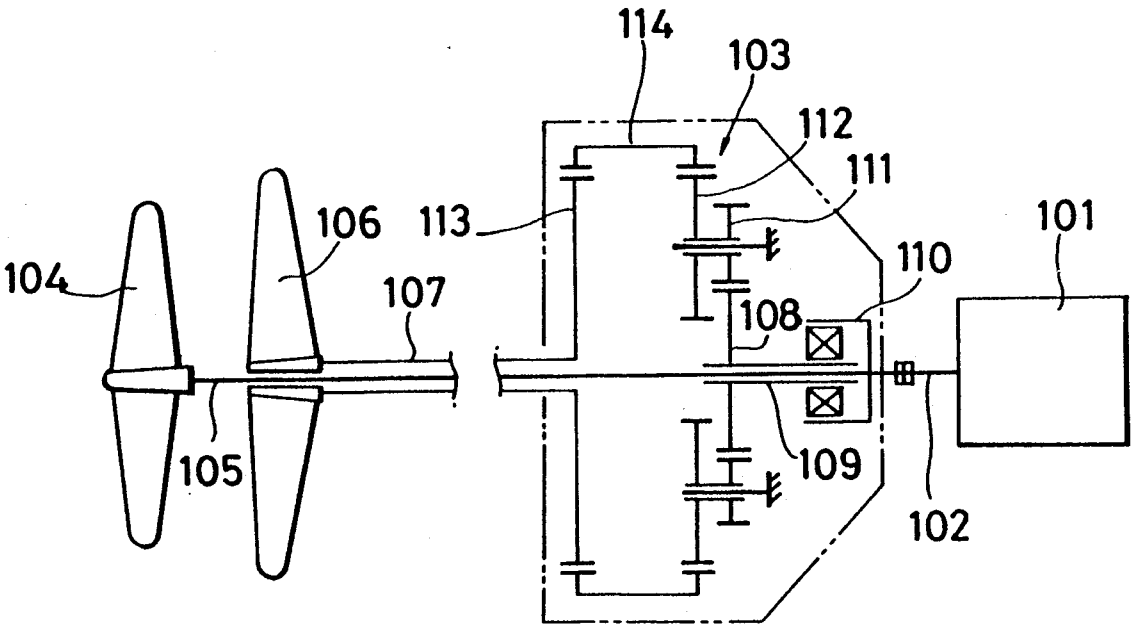
FIG. 6 is a schematic diagram showing a construction of a conventional propulsion torque transmitting arrangement.

Since there are provided a plurality of clutches 22, the torque imposed on each clutch 22 is relatively small. Also, the torque on the clutch 22 is reduced by the sun gear and the first plaranetary gears 10. The reduction is proportional to the gear ratio of the first planetary gear 10 and the sun gear 9. If the sun gear has 93 teeth, the first planetary gear has 27 teeth and there are provided eight first planetary gears 10, the torque on the clutch 22 is only 3.6% of the torque on the clutch 110 of FIG. 6, i.e.:

$$\frac{27}{93} \times \frac{1}{8} = \frac{3.6}{100}$$

Therefore, a clutch of small capacity can be employed. This makes the arrangement compact. Also, the maintenance of the clutches 22 becomes easier.

The clutch 22 is provided on the extension 24 of the first planetary gear 10 and spaced from the output shaft 23 of the engine 7. Thus, it is unnecessary to remove the output shaft 23, the inner propeller shaft 6 and the outer propeller shaft 5 at the maintenance of the clutches 22. A technician can access the clutch by only removing a casing (not shown) for the clutch 22. A uniform torque transmission can be achieved by adjusting the degree of connection of the clutches 22. Therefore, severe accuracy is not required in the first and second planetry gears 10 and 14.

Figure 5:
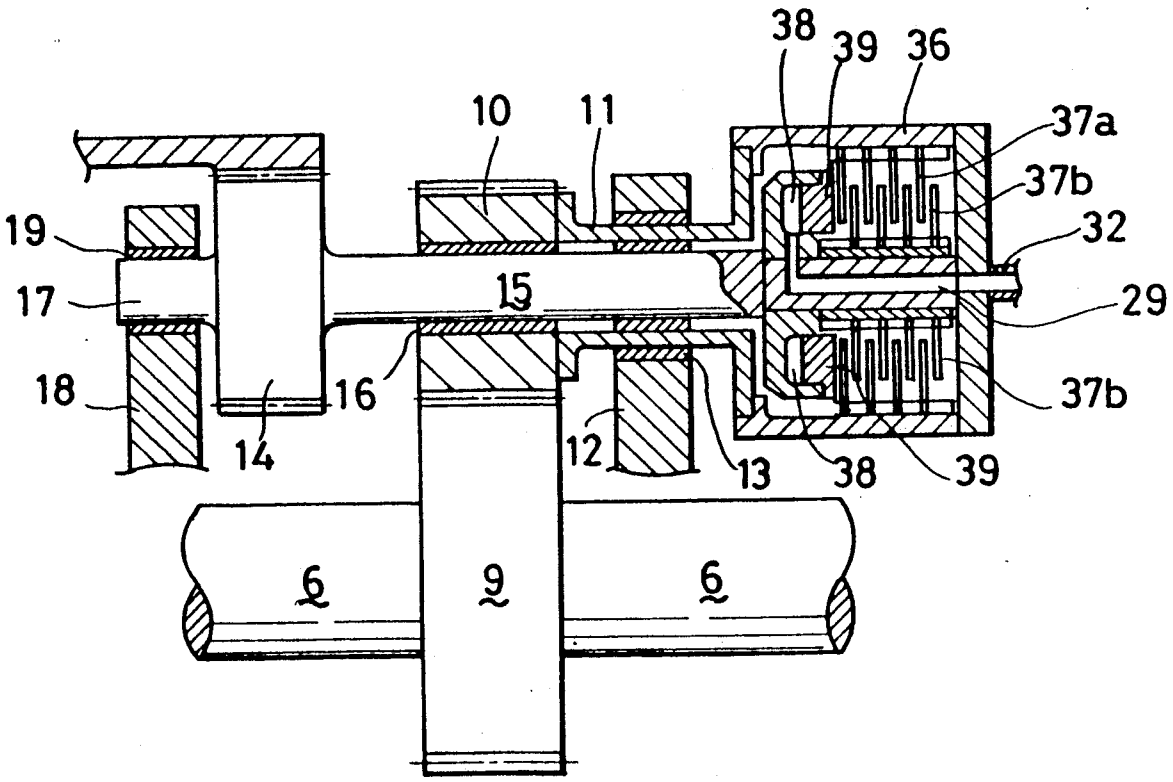
FIG. 5 shows another embodiment according to the present invention.

The clutch 22 uses the elastic tube 27 so that the vibration of the planetary gear set 8 is absorbed by the clutch FIG. 5 shows another embodiment of the present invention. The clutch of this embodiment is a so-called wet, multi-plate type clutch 22*a*. A clutch housing 36 is mounted on the shaft 11 of the first planetary gear 10. The clutch housing 36 is cylindrical in shape and the extension 15 of the second planetary gear 14 extends into the clutch housing 36. A first plurality of clutch plates 37*a* are mounted on the inner wall of the clutch housing 36 and a second plurality of clutch plates 37*b* are mounted on the second planetary gear shaft 15. The clutch plates 37*a* and 37*b* extend alternately in the radial direction of the second planetary gear shaft 15. The clutch plates 37*a* are movable on the inner wall of the clutch housing 36 because of a spline structure and the clutch plates 37*b* are movable on the second planetary gear shaft 15 because of the spline structure. When the working fluid is introduced into the clutch cylinder 38 via the passage 29, a piston 39 is moved to the right in the drawing and then the first and second clutch plates 37*a* and 37*b* are engaged with each other. Thereupon, the first planetary gear 10 is connected with the second planetary gear 14 and the outer propeller shaft 5 rotates in a direction opposite to the direction the inner propeller shaft 6 rotates. The operation and advantages of this example is similar to the foregoing example.

What is claimed is:

1. An arrangement for transmitting power from an engine to front and rear propellers of a ship, comprising:

an inner propeller shaft coupled to the rear propeller at one end thereof and coupled to the engine at the other end thereof;

an outer propeller shaft coupled to the front propeller;

a planetary gear set provided between the inner propeller shaft and the outer propeller shaft in a manner such that the inner propeller shaft rotates in a direction opposite to the direction the outer propeller shaft rotates, the planetary gear set including a sun gear mounted on the inner propeller shaft, a plurality of first planetary gears meshing with the sun gear, each first planetary gear having a shaft extending toward the engine, a plurality of second planetary gears, each second planetary gear having a shaft which extends coaxial with the first planetary gear shaft and is rotatable relative to the first planetary gear shaft; and a clutch provided between the first planetary gear shaft and the second planetary gear shaft for connecting and disconnecting the first planetary shaft with and from the second planetary gear shaft.

2. The arrangement of claim 1, further including a speed sensor for detecting the speed of an output shaft of the engine and a controller for allowing the clutch to connect the first planetary gear shaft with the second planetary gear shaft when the speed detected by the sensor is beyond a predetermined value and for allowing the clutch to disconnect the first planetary gear shaft from the second planetary gear shaft when the speed detected is equal to or below the predeterimed value.

3. The arrangement of claim 1, wherein the planetary gear set further includes an internal gear meshing with the second planetary gears and an external gear meshing with the internal gear and the external gear is mounted on the outer propeller shaft.

4. The arrangement of claim 3, wherein the first planetary gear shaft is a hollow shaft and the second planetary gear shaft rotatably extends through the first planetary gear shaft.

5. The arrangement of claim 4, wherein the clutch includes an expandable elastic tube and the elastic tube is fixed on the second planetary gear shaft in a manner such that the clutch connects the first planetary gear shaft with the second planetary gear shaft when the elastic tube is expanded to contact the first planetary gear shaft and disconnects the first planetary gear shaft from the second planetary gear shaft when the elastic tube is contracted.

6. The arrangement of claim 5, wherein the elastic tube is provided with a lining on that part which contacts the first planetary gear shaft when the elastic tube is expanded.

7. The arrangement of claim 6, wherein a passage for introducing working fluid into the elastic tube is formed in the second planetary gear shaft and the elastic tube is expanded as the working fluid is introduced to the elastic tube.

8. The arrangement of claim 7, further including a controller for controlling an introduction of the working fluid into the elastic tube.

9. The arrangement of claim 8, further including a sensor for detecting the rotational speed of an output shaft of the engine.

10. The arrangement of claim 9, further including a controller for allowing the clutch to connect and disconnect the first planetary gear shaft with and from the second planetary gear shaft in a manner such that the engine is not operated at a natural frequency of the power transmission arrangement.

11. The arrangement of claim 1, wherein the clutch is a wet, multi-plate type clutch.

12. The arrangement of claim 2, wherein the planetary gear set further includes an internal gear meshing with the second planetary gears and an external gear meshing with the internal gear and the external gear is mounted on the outer propeller shaft.

13. The arrangement of claim 12, wherein the first planetary gear shaft is a hollow shaft and the second planetary gear shaft rotatably extends through the first planetary gear shaft.

14. The arrangement of claim 13, wherein the clutch includes an expandable elastic tube and the elastic tube is fixed on the second planetary gear shaft in a manner such that the clutch connects the first planetary gear shaft with the second planetary gear shaft when the elastic tube is expanded to contact the first planetary gear shaft and disconnects the first planetary gear shaft from the second planetary gear shaft when the elastic tube is contracted.

15. The arrangement of claim 14, wherein the elastic tube is provided with a lining on that part which contacts the first planetary gear shaft when the elastic tube is expanded.

16. The arrangement of claim 15, wherein a passage for introducing working fluid into the elastic tube is formed in the second planetary gear shaft and the elastic tube is expanded as the working fluid is introduced to the elastic tube.

17. The arrangement of claim 16, further including a controller for controlling the introduction of the working fluid into the elastic tube.

18. The arrangement of claim 2, wherein the clutch is a wet, multi-plate type clutch.

* * * * *